US005222535A

United States Patent [19]

Roders

[11] Patent Number: 5,222,535

[45] Date of Patent: Jun. 29, 1993

[54] BAG HOLDING DEVICE

[76] Inventor: George W. Roders, 5014 38 Ave., Kenosha, Wis. 53144

[21] Appl. No.: 796,176

[22] Filed: Nov. 22, 1991

[51] Int. Cl.[5] ..... B65B 1/04

[52] U.S. Cl. ..... 141/314; 141/114; 141/315

[58] Field of Search ..... 141/114, 314, 315, 316, 141/317, 10; 53/570, 571, 384.1

[56] References Cited

U.S. PATENT DOCUMENTS

| | | | |
|---|---|---|---|
| 1,667,930 | 5/1928 | Edmunds | 141/314 |
| 2,159,858 | 5/1939 | Neuman et al. | 141/314 |
| 2,301,804 | 11/1942 | Frye | 248/101 |
| 2,376,810 | 5/1945 | Richardson | 226/55 |
| 2,409,626 | 10/1946 | Harrington et al. | 226/59 |
| 2,540,615 | 2/1951 | Harrington et al. | 226/59 |
| 2,561,306 | 7/1951 | Anderson | 248/99 |
| 2,637,477 | 5/1953 | Tucker | 226/59 |
| 2,784,749 | 2/1957 | Baker | 141/314 |
| 2,890,006 | 6/1959 | Hopkins | 248/101 |
| 2,910,257 | 10/1959 | Gibbons | 248/101 |
| 2,910,258 | 10/1959 | Sheetz | 248/101 |
| 3,112,777 | 12/1963 | Lohse | 141/316 |
| 3,269,430 | 8/1966 | Belk | 141/315 |
| 3,298,647 | 1/1967 | Shepard | 248/101 |
| 3,707,826 | 1/1973 | Cole | 53/384 |
| 3,771,578 | 11/1973 | Huff | 141/314 |
| 3,973,603 | 8/1976 | Franz | 141/114 |
| 4,423,583 | 1/1984 | Carey | 53/384.1 |
| 4,947,625 | 8/1990 | Zike | 53/459 |

*Primary Examiner*—Henry J. Recla
*Assistant Examiner*—David J. Walczak
*Attorney, Agent, or Firm*—Quarles & Brady

[57] ABSTRACT

A bag holder device having an anvil portion and an elongated member pivotally attached to the body member with the arm member having a bag engaging end portion for contacting the anvil surface. A biasing member is connected between the arm member and the body member to bias the bag engaging end against an inside surface of the anvil. When a portion of a bag is placed between the bag engaging end portion and the anvil surface, the bag is firmly gripped and any downward force on the bag causes a firmer gripping action of the bag by pivoting the bag engaging portion against the anvil surface. A filling machine is also presented wherein a pair of the holder devices transport a bag through several work stations with both holder devices being automatically opened and one of the holder devices being pivoted laterally to aid in receiving a bag between the pairs of holder devices.

8 Claims, 2 Drawing Sheets

FIG. 5.
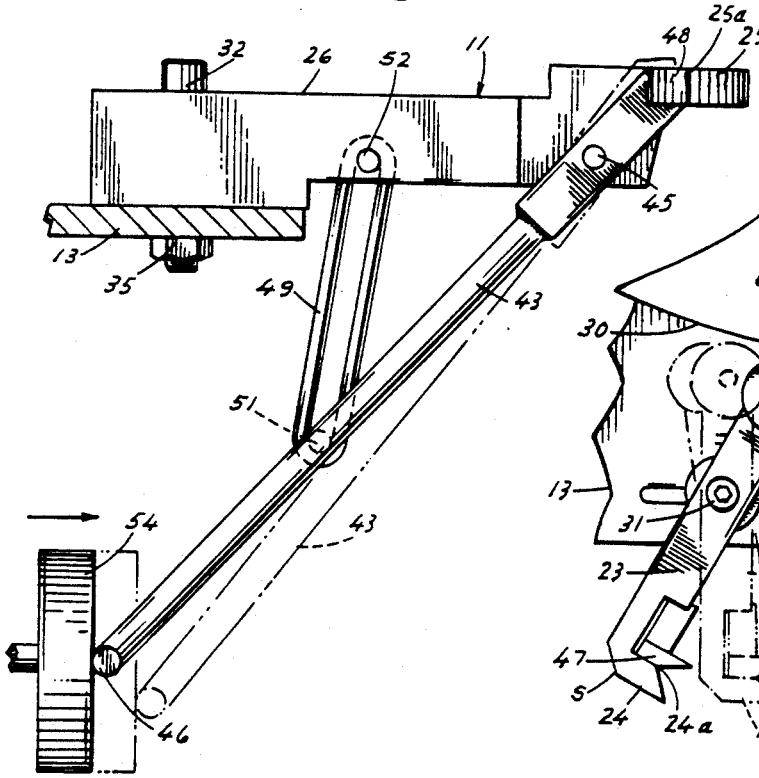
FIG. 3.
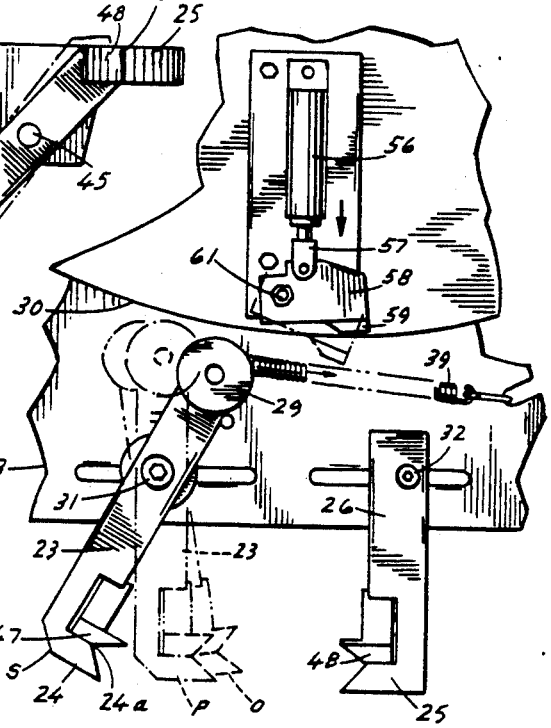
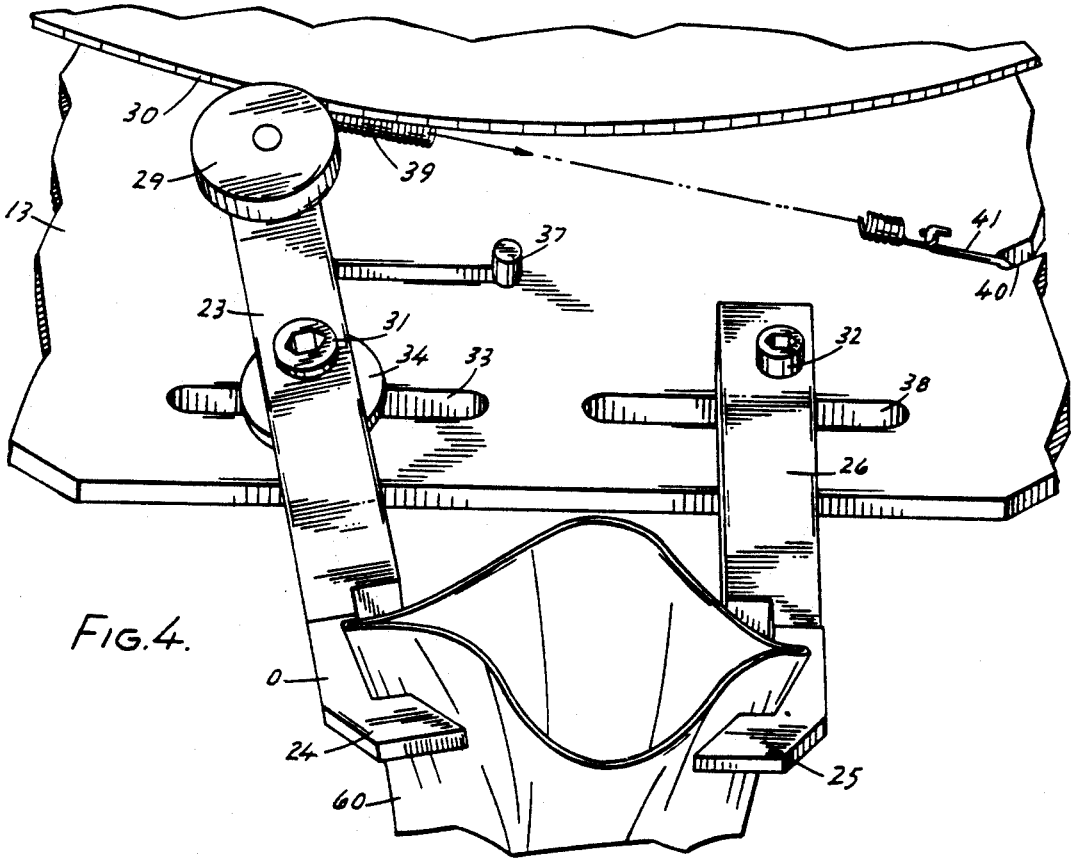
FIG. 4.

BAG HOLDING DEVICE

BACKGROUND OF THE INVENTION

This invention relates to a device for holding flexible bags. More particularly, it relates to a device for holding flexible bags in a secure manner as well as in an open condition and in conjunction with a machine for filling and sealing bags.

There are currently available several types of machines for holding bags during a filling or similar operation. For example in U.S. Pat. No. 2,301,804 a holding action is accomplished by an eccentric disk in conjunction with a concentrically mounted disk. In U.S. Pat. No. 2,561,306 moveable jaws are provided with companion jaws. In U.S. Pat. No. 2,910,257 a bag gripping action is effected by clamp plates with pads acting against serrated plates to grip an upper edge of the bag.

The prior art provides bag holding devices which are multicomponent or involve the movement of many parts. There is not presently available a bag holding device which has a simplified construction yet is positive in its holding of a flexible bag. Neither is there available a simplified bag holding unit which readily adapts itself to use in a bag filling and sealing machine wherein the unit can be easily opened and closed as well as moved laterally to receive the bag.

It is an advantage of the present invention to provide a bag holding device which is simple in its construction yet affords a positive holding of a bag.

It is another advantage of the invention to provide a bag holding device of the foregoing type which is especially suited for use in an automated bag filling and sealing machine.

It is still another advantage of the invention to provide a bag holding device of the foregoing type which is especially suited for holding flexible lightweight plastic bags.

It is still a further advantage of the invention to provide a bag holding device of the foregoing type which is easily maintained and operable at low cost.

SUMMARY OF THE INVENTION

The foregoing advantages are accomplished and the shortcomings of prior art bag holding devices are overcome by the present bag holding device and machine utilizing the bag holding device, wherein the bag holder device has a body member presenting an anvil portion and an arm member pivotally attached to the body member. The arm member has a bag engaging end portion and is constructed and arranged to contact an anvil portion on an inside surface thereof. A biasing means is connected between the arm member and the body member to bias the bag engaging end portion against the anvil inside surface. When a portion of a bag is placed between the bag engaging end portion and the anvil surface the bag is firmly gripped and any downward force on the bag causes a firmer gripping action on said bag by rotating the bag engaging portion against the anvil surface.

In a preferred embodiment, the arm member is defined by an elongated rod-like member and the biasing means is connected to the rod-like member and the body member intermediate the ends thereof.

In another embodiment there is a machine for filling flexible bags or the like which incorporates a pair of the bag holder devices. It includes a rotatable table member with at least one pair of the bag holder devices connected to the table member. There are extension and retraction means operatively associated with the table member to selectively engage the arm members of the bag to move the arm members away from the anvil surface to receive or release the bag. There are also camming means to laterally move one of the holder devices with respect to the other.

BRIEF DESCRIPTION OF THE DRAWING

A better understanding of the present bag holder device will be had by reference to the drawing wherein:

FIG. 3 is a top plan view illustrating the motion of one of the holders in conjunction with the filling machine.

FIG. 4 is a view similar to FIG. 2 illustrating a camming movement of one of the bag holders in conjunction with a flexible bag.

FIG. 5 is a view in side elevation showing a bag holder of this invention as actuated in conjunction with the filling machine.

DESCRIPTION OF THE PREFERRED EMBODIMENT

Figure 1:
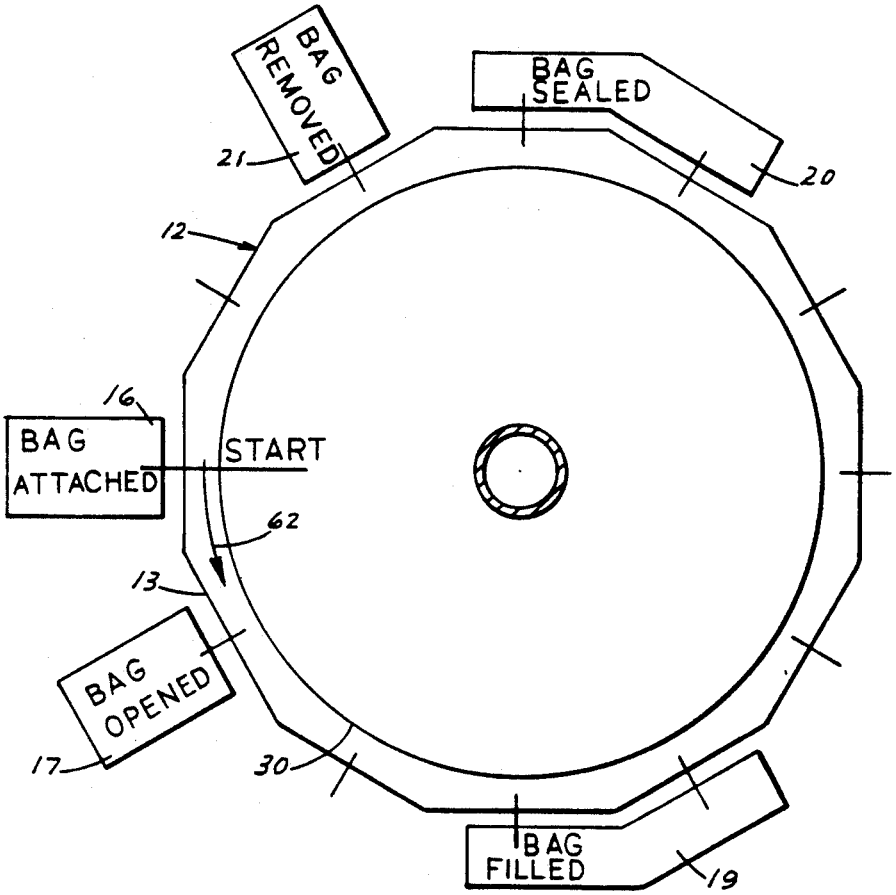
FIG. 1 is a top plan view of a bag filling machine utilizing the bag holders of this invention and with the various processing stations shown diagrammatically.
Figure 2:
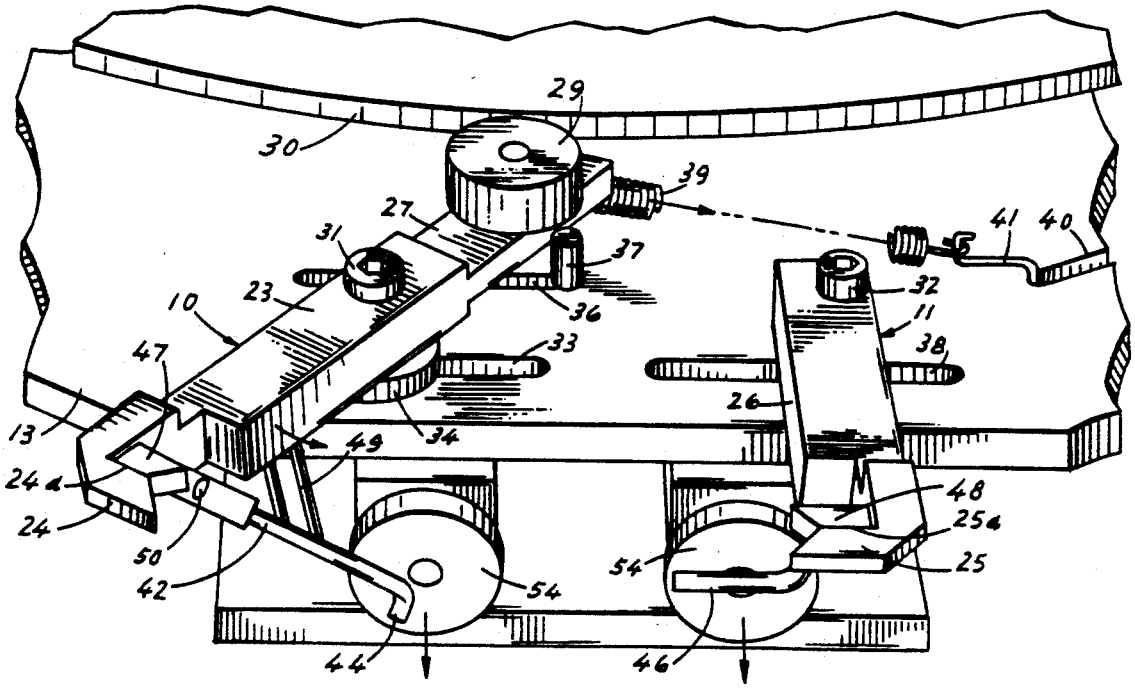
FIG. 2 is a top perspective view showing the bag holder of this invention as positioned on the filling machine of FIG. 1.

Proceeding to a detailed description of the invention and referring particularly to FIGS. 1 and 2, the bag holder device of this invention is utilized in pairs as will be seen from reference numerals generally 10 and 11. They are operatively connected to a table 13 of the filling machine generally 12. The filling machine 12 has the usual support post 14 as well as drive means for rotating the table in a suitable manner. Positioned outwardly of the table 13 are the usual work stations such as represented by a bag attached station 16, a bag opened station 17, a bag filled station 19, a bag sealed station 20, and a bag removed station 21. These stations are of the type which handle small flexible type plastic bags.

Referring specifically to FIG. 2, the bag holder 10 includes a body member 23 having an anvil portion 24. Similarly, bag holder 11 has a body member 26 also with an anvil portion 25. Bag holder 10 differs from bag holder 11 in that the body portion includes an arm portion 27 to which is rotatably attached a rotatable cam follower 29 for engagement with a cam surface 30 which forms a part of the bag filling machine 12 and is positioned above the table 13. Body member 23 of bag holder 10 is pivotally attached to the table 13 by means of the pivot post 31 and the washer 34 with adjustment being afforded by the slot 33. The body member 26 of bag holder 11 is secured to the table 13 through the adjustment slot 38 by the bolt 32 engaged by the fastening nut 35. This is seen in conjunction with FIG. 5. Body member 23 has a biasing spring 39 attached to the arm portion 27 as well as to the hook 41 positioned in the slot 40. This affords a positioning of the body member 23 as indicated in FIG. 2 with arm portion 27 contacting stop post 37.

Pivotally attached to the body member 23 of bag holder 10 is the arm member 42 which pivotal attachment is afforded by the pivot pin 50. A contact portion 44 extends from the arm member 42 for contact with the contact head 54 of a standard pneumatic cylinder arm which pneumatic cylinder will be suitably supported beneath the table 13. The bag engaging portion 47 of the pivotal arm member 42 is biased against the anvil surface 24*a* of the portion 24 by the biasing means 49. Bag holder 11 also has a similar pivoted elongated arm member 43. This aspect is better visualized in conjunction with FIG. 5. There it is seen that a pivoting of the arm member 43 is provided by the pivot pin 45 connected to the body member 26. An elastic biasing means 49 is connected to the post 52 attached to the body member 26 and to the post 51 attached to the pivotal arm 43. The biasing means in this instance is an elastomeric band. This biasing action as is true of biasing means 49 and arm member 42 forces the bag engaging portion 48 against the anvil surface 25*a* of anvil portion 25.

OPERATION

A better understanding of the advantages of the bag holders 10 and 11 of this invention will be had by a description of their operation and in conjunction with the filling machine 12. The table 13 of the filling machine 12 is rotated in the direction of the arrow 62. Referring first to FIG. 1 and the bag attached station 16, as the holders 10 and 11 enter this station, the body member 23 of bag holder 10 will assume a position as shown in FIG. 2 and as indicated by the letter "S" in FIG. 3, after leaving the bag removed station 21. This is effected by the biasing spring 39. The table 13 stops at this station with body member 23 in the "S" position. At this time it is necessary for the respective pivotal arms 42 and 43 to be moved so that the bag engaging portions 47 and 48 are moved away from the respective anvil portions 24 and 25. This is effected by the contact heads 54 being moved outwardly from the table 13 so as to contact the respective contact portions 44 and 46. Subsequently, a bag 60 is moved into position between bag holders 10 and 11 and between bag engaging portion 48 and anvil surface 25*a* of holder 11 as illustrated by the phantom line showing of arm 43 in FIG. 5. The next step is for bag holder 10 to be rotated so as to have a portion of bag 60 positioned between bag engaging portion 47 and anvil surface 24*a*. This is effected by the pneumatic cylinder 56 and the cam arm 58 with the cam surface 59 contacting wheel 29 and pushing body member 23 to the position indicated by the letter "P" in FIG. 3.

With the bag 60 in the previously described position, and an outward portion of a flexible bag 60 positioned against the respective anvil surfaces 24*a* and 25*a*, the contact heads 54 are retracted with the biasing means 49 urging the engaging portions 47 and 48 against the edges of the bag and against the respective anvil surfaces 24*a* and 25*a*. Bag holders 10 and 11 stay in position "P" while holding the bag 60. As the table 13 approaches the bag opened station 17, the wheel 29 begins a slight contact with the cam surface 30. This results in the bag being opened in station 17. It should be pointed out in the usual manner that station 17 is equipped with both vacuum and air sources to open the bag 60 as illustrated in FIG. 4. As table 13 moves out of station 17 and towards bag filled station 19, the wheel 29 engages the cam surface 30 in a progressively increasing degree until at station 19 the bag 60 is in an open condition as shown in FIG. 4 and shown by the letter "0" in FIGS. 3 and 4. In this position the bag 60 is filled at station 19 and the bag open position is maintained by the contact of the cam roller 29 with the cam surface 30 until just preceding the bag sealed station 20 at which time the cam roller 29 no longer contacts the cam surface 30 and the spring tension afforded by the spring 39 causes the body member 23 to rotate in a clockwise position back to that indicated at "P" to thereby hold the bag 60 in a closed position.

After the bags are sealed such as at the bag sealed station 20 the bags are removed from the filling machine 12 as at bag removed station 21. This is effected by the actuation of the contact heads 54 which by their outward movement will again contact the contact portions 44 and 46 to thereby pivot the respective arms 42 and 43 and move the bag engaging portions 47 and 48 of the respective bag holders 10 and 11 away from the anvil portions 24 and 25 to thereby release the bag. After release of the bag 60 and withdrawal of the contact heads 54 the bag engaging portions 47 and 48 return to engage the respective anvil portions 24 and 25 and the body members 23 and 24 assume a position as indicated in FIG. 2. The procedure as previously described is then repeated with respect to the stations 16, 17, 19, 20 and 21.

It should be noted especially in conjunction with FIG. 2 that the contact portions 44 and 46 are of a different configuration for contact with the contact heads 54. This is to allow the swinging motion of the arm 42 over the surface of the contact head 54 in a rotating like manner. This could not be effected by the contact portion 46 although contact portion 46 allows for a more positive engagement with the contact head 54.

It should be appreciated in connection with the biasing of the pivotal arms 43 such as shown in FIG. 5 by the biasing means 49 that when a portion of a flexible bag 60 is placed between the anvil portion 25 and the bag engaging portion 48 that any additional weight in the bag effects a downward force. This causes a clockwise rotation of the bag engaging portion and further clamping action of the bag engaging portion 48 against the anvil portion 25 and the contacting portion 25*a*. Both the bag engaging portions 47 and 48 have roughened surfaces to assist in the holding of the flexible bag 60.

It is thus seen that very efficient clamping action is afforded by the stationary anvil portion 25 and the levered bag engaging portion 48. Only a minimum amount of biasing force is required by the elastomeric biasing means 49. If desired, a light force type spring could be substituted. While a flexible bag 60 has been indicated as a preferred means of utilizing the bag holders 10 and 11, it will be appreciated that bags of various construction whether flexible or semi-flexible and including those made from paper can be utilized to advantage.

In the foregoing operation, a bag 60 was placed between bag holders 10 and 11 at station 16 by a swing arm arrangement which is standard in the industry for this type of equipment. It is contemplated to employ a device which involves a rotatary motion in its place if desired.

The foregoing invention can now be practiced by those skilled in the art. Such skilled persons will know that the invention is not necessarily restricted to the particular embodiments presented herein. The scope of the invention is to be defined by the terms of the following claims as giving meaning by the preceding description.

I claim:

1. A machine for filling flexible bags or the like comprising:

a table member;

at least one pair of bag holder devices connected to said table member, each said at least one pair of bag holder devices including a bag holder device comprising:

a body member presenting an anvil portion;

an arm member pivotally attached to said body member, said arm member having a bag engaging end portion, said arm member constructed and arranged to contact said anvil portion on an inside surface thereof to effect a clamping action between said bag engaging end portion and said anvil portion when a portion of a bag is placed therebetween and a material is placed therein such that the weight of the flexible bag and its contents causes said bag engaging end portion to pivot toward said anvil portion and thereby strengthen the clamping action between said bag engaging end portion and said anvil portion;

biasing means connected between said arm member and said body member to bias said bag engaging end portion against said anvil inside surface; and extension and retraction means operatively associated with said table member to selectively engage said arm members to move said arm members away from said anvil surface.

2. The machine as defined in claim 1 wherein said body member of one of said pair of said bag holder devices is rotatably connected to said rotatable table member for movement toward and away from another holder device comprising said pair of bag holder devices.

3. The machine as defined in claim 2 wherein said body member further includes a cam follower connected to said body member adapted for camming contact with a camming surface on a bag filling machine to pivot said body member and said arm member away from said another holder device.

4. The machine as defined in claim 3 wherein said camming surface is positioned above said rotatable table.

5. The machine as defined in claim 1 wherein said arm member is defined by an enlarged rod-like member and said biasing means is connected to said rod-like member and said body member intermediate the ends thereof.

6. The machine as defined in claim 5 wherein said biasing means is defined by an elastic member.

7. The machine as defined in claim 5 wherein said rod-like member terminates in an angular leg portion.

8. The machine as defined in claim 7 wherein said angular leg portion is of a different configuration on said rod-like member comprising said pair of bag holder devices.

* * * * *